United States Patent [19]

Nichols

[11] Patent Number: 4,627,126

[45] Date of Patent: Dec. 9, 1986

[54] CLEANING DEVICE FOR HOOK AND LOOP FASTENERS

[76] Inventor: Thomas K. Nichols, 365 Amity Rd., Andover, N.J. 07821

[21] Appl. No.: 772,683

[22] Filed: Sep. 5, 1985

[51] Int. Cl.[4] ..... A47L 25/00

[52] U.S. Cl. ..... 15/105; 15/104 R; 15/104 A; 15/142

[58] Field of Search ..... 15/104 R, 104 A, 104.5, 15/105, 114, 142, 209, 210 R; 24/306

[56] References Cited

U.S. PATENT DOCUMENTS 3,363,276 1/1968 Thomas, Jr. ..... 15/104 A

FOREIGN PATENT DOCUMENTS 2620235 11/1977 Fed. Rep. of Germany ... 15/104 A 439214 12/1967 Switzerland ..... 15/104 A

*Primary Examiner*—Edward L. Roberts

*Attorney, Agent, or Firm*—Richard D. Weber

[57] ABSTRACT

A cleaning device for cleaning the hooked portion of hook and loop fasteners includes a body member defining a curved surface on which is mounted a strip of hooked fastener material. A debris collecting surface of sticky, resilient material is disposed adjacent one edge of said hooked fastener material in substantially tangential alignment therewith. In a preferred embodiment of the invention, the sticky surface is disposed on a replaceable, rotatable cylindrical roll. The repeated stroking movement of the hooked fastener material over the surface to be cleaned effects a loosening of debris which is collected on the sticky surface.

17 Claims, 7 Drawing Figures

CLEANING DEVICE FOR HOOK AND LOOP FASTENERS

BACKGROUND OF THE INVENTION

The present invention relates generally to cleaning equipment and relates more particularly to a device for cleaning hook and loop fasteners.

Hook and loop fasteners, such as the type sold under the trademark "VELCRO" by Velcro USA Inc., Nutley, N.J., are used in a variety of fields, particularly in garments as flap and pocket closures. They are also used to secure an adjustable detachable band holding an item temporarily in place. Examples of such usage include sporting equipment wherein hook and loop fasteners are used to attach tent flys to supporting poles, bicycle accessories to bicycle frames, and, in place of shoelaces, to adjustably secure shoes to a wearer's foot. Another area wherein hook and loop fasteners have enjoyed widespread usage is in the medical equipment field. Adjustable pneumatic cuffs for blood pressure testing and patient securing straps for CAT scanners are just a few examples of such usage.

Although hook and loop fasteners serve admirably for these and other purposes in view of their infinite adjustability, durability, light weight and ease of attachment by sewing or gluing, there nonetheless remains one noticeable disadvantage of such fasteners which is the tendency of the hooked fastener portion to attact and collect all sorts of debris including hair, lint and other particles which become enmeshed in and trapped by the closely spaced plastic hooks. The looped portion of the fastener in contrast does not have this undesirable collecting characteristic and remains in a clean condition even in a debris filled environment.

Although it might be expected that the collected debris could be dislodged from the hooked fastener portion by relative movement of the looped portion therealong, in fact this has practically no cleaning affect since the closed loops are unable to pick up and detach the debris from the hooks and, furthermore, the hooks tend to seize the loops, arresting relative movement.

It has also been suggested that the hooked fastener portion be cleaned by raking another hooked fastener portion through it. This is difficult to carry out since any debris picked up by the second hooked portion on one stroke is likely on the next stroke to become retransferred back onto the initial hooked portion. It is thus necessary to manually pick off the individual pieces of debris between cleaning strokes, lest they return to the original hooked fastener material. In addition, such a process is time consuming and relatively awkward, since a small limp piece of hooked fastener material is difficult to manipulate over a large fastener area to produce any significant cleaning effect.

In medical equipment, the hooked and looped fastener bands are often relatively large in area and are often in contact with hair, clothing, dressings, skin and other debris contributing materials. Since cleanliness is of special importance in medical devices, it can be understood that the tedious process described cannot be considered a satisfactory solution to the fastener cleaning problem.

SUMMARY OF THE INVENTION

The present device comprises a body member defining a convexly curved surface on which is mounted a strip of hooked fastener material. Means are provided for presenting a debris collecting surface of sticky, preferably resilient material closely adjacent one edge of the hooked fastener material in substantially tangential alignment with the hooks of the curved material surface. In a preferred embodiment of the invention, the sticky resilient material is disposed on a rotatable cylindrical roll. A handle or other gripping means on the body member permits the stroking movement of the device over a hooked fastener surface to be cleaned, the device being drawn so that the sticky material trails the curved surface bearing the hooked fastener material. Debris dislodged by the hook elements is collected on the sticky resilient material, which may be periodically replaced.

It is accordingly a primary object of the present invention to provide a device for effectively removing and collecting debris from the hooked portion of hook and loop fasteners;

A further object of the invention is to provide a cleaning device as described of a simple, light weight, inexpensive construction.

Another object of the invention is to provide a cleaning device as described having a debris collecting element which when filled may be easily and economically replaced.

Still another object of the invention is to provide a cleaning device as described which may be formed as a one piece molded plastic structure.

Additional objects and advantages of the invention will be readily apparent from the following detailed description of embodiments thereof.

DESCRIPTION OF THE PREFERRED EMBODIMENTS

Figure 1:
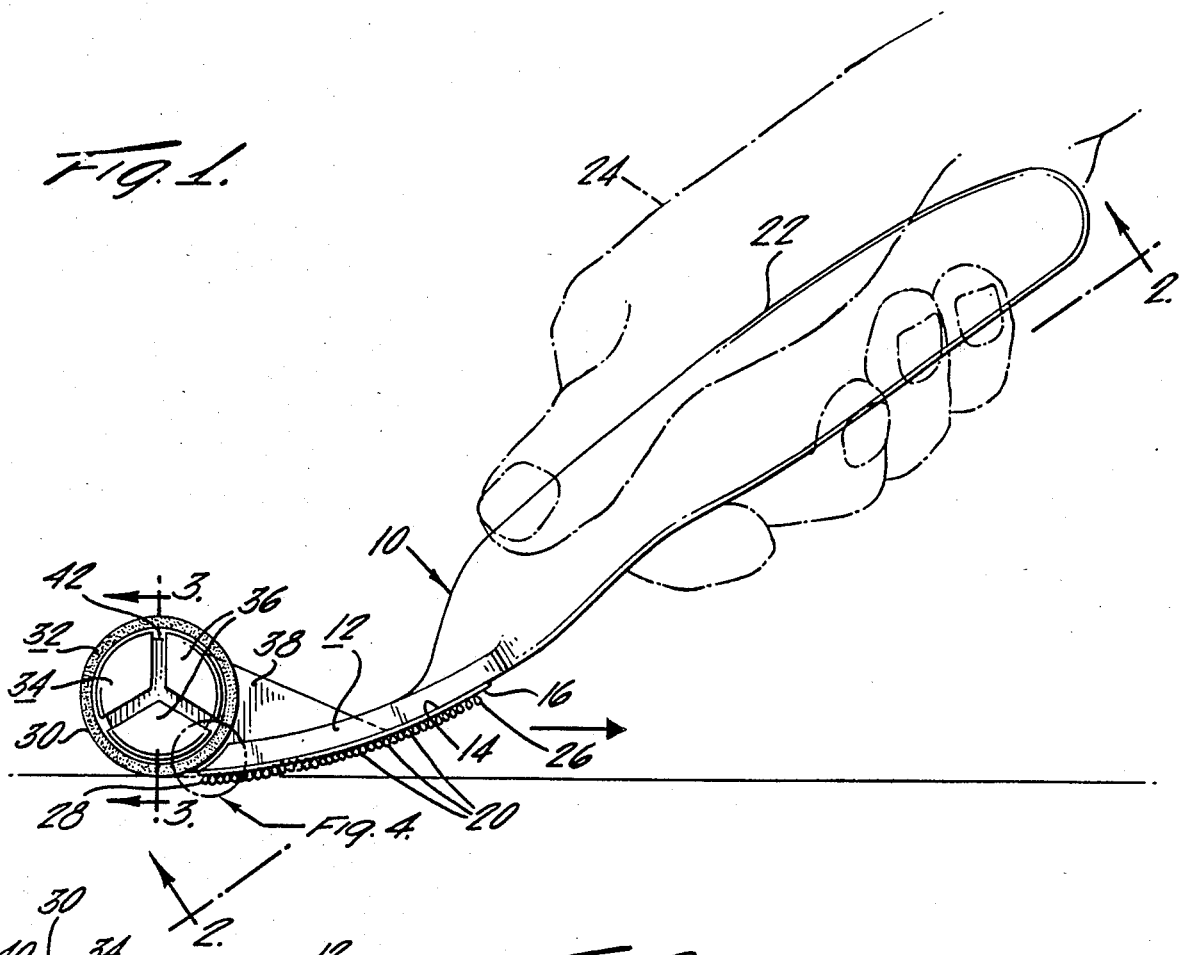
FIG. 1 is a side elevational view of a cleaning device in accordance with the present invention.

Referring to the drawings and particularly FIG. 1 thereof, a cleaning device generally designated 10 in accordance with the present invention includes a body member 12 which in the illustrated embodiment comprises a generally rectangular plate. The body member 12 is configured to provide a convexly curved lower surface 14 of a substantially rectangular shape as shown in the bottom plan view of FIG. 2.

Figure 4:
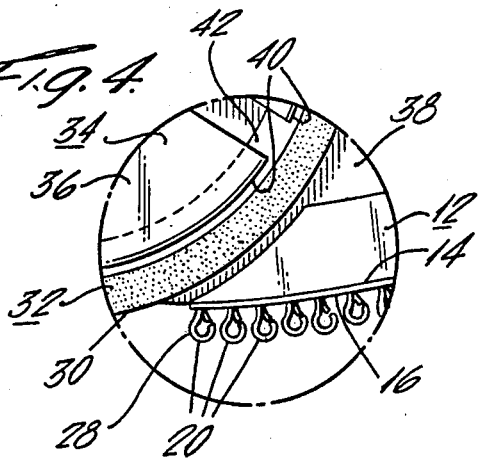
FIG. 4 is a greatly enlarged view of the detail within the dot and dash circled portion of FIG. 1.

A strip 16 of hooked fastener material is secured to the surface 14 by means of a suitable adhesive. The strip of hooked fastener material 16 is of a conventional construction, such as the type sold under the trademark "VELCRO" and includes a plurality of closely spaced parallel rows 18 of plastic hook elements 20 as may be most readily seen in the enlarged views of FIGS. 4 and 5.

Figure 2:
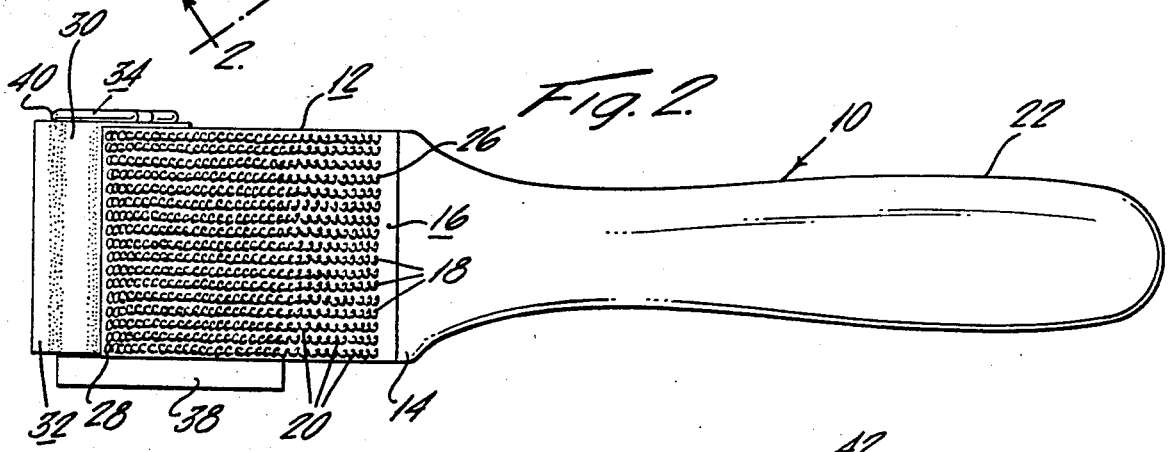
FIG. 2 is a bottom plan view taken along line 2—2 of FIG. 1.
Figure 3:
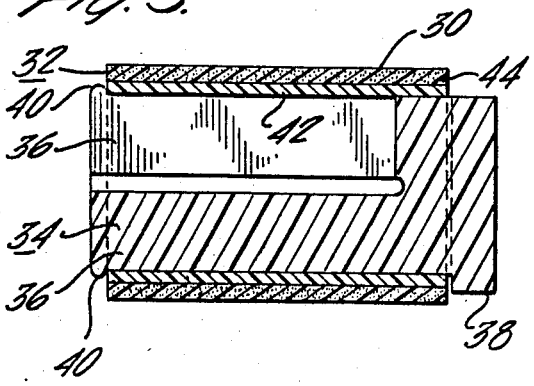
FIG. 3 is an enlarged sectional view taken along line 3—3 of FIG. 1 showing details of the roll construction and the roll supporting mandrel.

A handle 22 is attached to the right hand end of the body member 12 as viewed in FIGS. 1 and 2 to permit the grasping of the device by one hand 24 of the user as illustrated in FIG. 1. Since the device is used by applying repetitive strokes of the hooked fastener material 16 to a surface to be cleaned in the right hand direction as viewed in FIG. 1 and illustrated by the arrow, the edges of the hooked strip 16 perpendicular to the direction of motion are designated as the leading edge 26 and the trailing edge 28.

Disposed immediately adjacent the trailing edge 28 of the strip 16 of hooked fastener material and in substantially tangentially aligned relation with the arcuate curvature of the strip, is means defining a sticky, resilient surface 30 which in the embodiment of FIGS. 1-5 comprises a cylindrical roll 32. The roll 32 is rotatably supported by a split mandrel 34 formed of a plurality of mandrel elements 36 extending from a support arm 38 attached at one side of the body member 12. A flange 40 on the end of each of the mandrel elements 36 as shown most clearly in FIG. 3 holds the roll 32 axially in place on the mandrel.

The roll 32 comprises a cylindrical cardboard tube 42 to which is adhered a resilient layer 44 having a sticky outer surface 30. The roll 32 may be readily applied to or removed from the mandrel 34 by pinching inwardly on the mandrel elements 36 to resiliently inwardly displace the flanged mandrel element outer ends. Although the roll 32 is rotatable on the mandrel, as discussed below it preferably does not fit so loosely on the mandrel as to spin freely at the end of a cleaning stroke when the device is lifted from the surface being cleaned.

Figure 5:
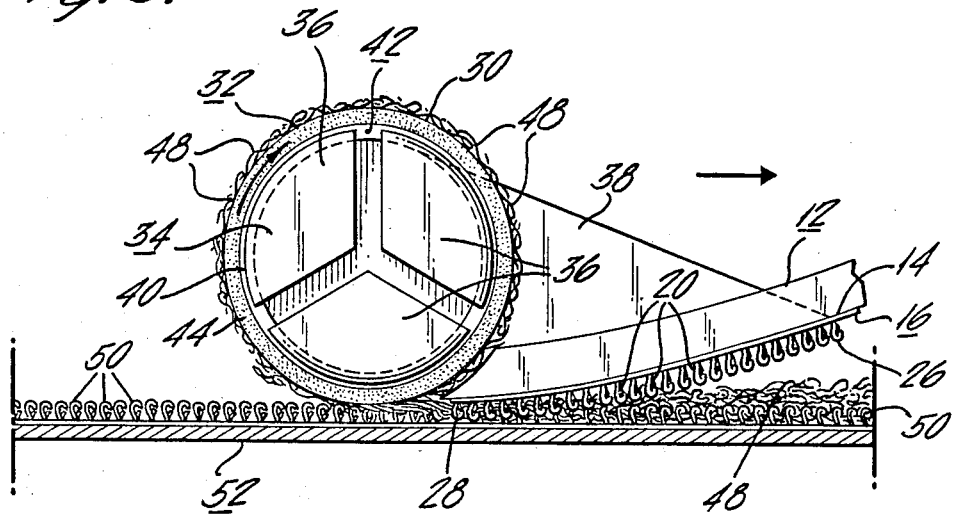
FIG. 5 is an enlarged partial side elevational view showing the cleaning device in operation.

For operation of the device, a roll 32 is placed on the mandrel 34 and, with the handle 22 grasped in one hand as shown in FIG. 1, the device is drawn in a series of short strokes in the direction of the arrow in FIGS. 1 and 5 to engage the strip of hooked fastener material 16 with the fastener material to be cleaned. The operation is illustrated in FIG. 5, wherein debris 48 such as hair, lint, etc., is shown caught in the hooks 50 of the hooked portion 52 of a hook and loop fastener. As the device is moved to the right as viewed in FIG. 5, the hooks 20 of the strip 16 become enmeshed with the hooks 50 of the material to be cleaned, thereby dislodging the debris 48 from the hooks 50. The dislodged debris is lifted to the surface of the hooks 50 and is immediately picked up and retained by the sticky surface 30 of the roll 32. The resilient layer 44 of the roll permits the deformation of the roll outer surface as it passes over the hooked fastener portion to be cleaned, thereby permitting the surface to engage and collect debris located somewhat below the outer ends of the hooks.

After the roll has become completely covered with debris, it is removed from the mandrel and discarded and a new roll slipped in place. The rolls are preferably packaged in such a manner that the sticky roll surfaces require a minimum of handling. Ideally, the rolls may be removed from the package without any handling by simply inserting the mandrel into a roll while it is still in the package. Alternatively, the rolls could be provided with a non-adhering sheet, such as of plastic material, which could be removed from the roll just prior to usage and replaced to permit storage of the device without attracting additional debris or sticking fast to engaged surfaces.

Figure 6:
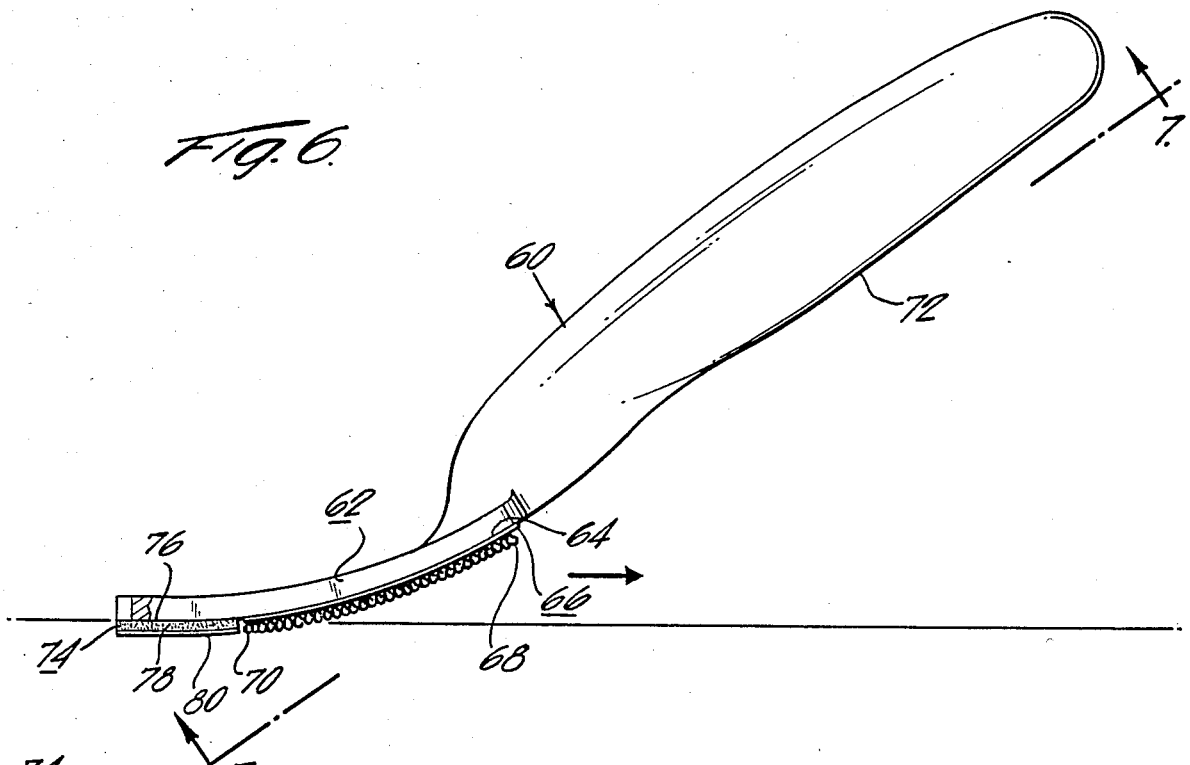
FIG. 6 is a side elevational view of another embodiment of the invention.
Figure 7:
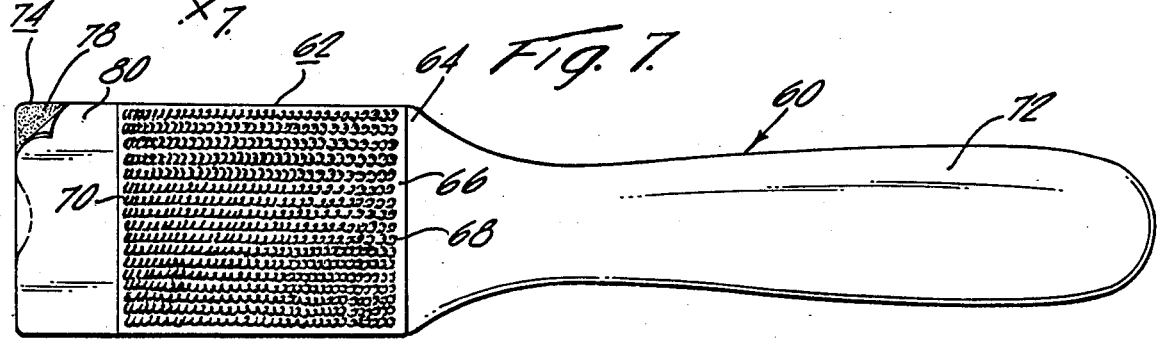
FIG. 7 is a bottom plan view taken along line 7—7 of FIG. 6.

The embodiment of FIGS. 6 and 7 is similar in construction and usage to that described with the exception that the sticky surface is defined by an essentially flat pad of sticky material rather than a roll. The modified device generally designated 60 includes a body member 62 in the form of a curved plate having a convexly curved lower surface 64 to which a strip 66 of hooked fastener material is secured. The strip 66 extends from a leading edge 68 perpendicular to the direction of movement of the device to a trailing edge 70. A handle 72 is attached to the body members 62 at one end thereof.

At the opposite end of the body member 62 from the handle, and applied closely adjacent the trailing edge 70 of the hooked fastener strip 66, is a strip 74 of sticky resilient material applied to a continuation 76 of the surface 64 of the body member 62. The surface 76 is essentially flat and locates the outer sticky surface 78 of the strip 74 in substantially tangential alignment with the curved hooked strip 66. A thin plastic cover sheet 80 is shown applied to the sticky surface 78, which cover sheet is removed to expose the sticky surface during use of the device.

The operation of the embodiment of FIGS. 6 and 7 is identical to that of FIGS. 1-5, debris loosened by the hooked strip 66 being picked up and retained by the sticky surface 78. When the surface 78 has become loaded with debris, the strip 74 is peeled from the surface 76 and a replacement strip is adhesively applied in its place.

The degree of curvature of the curved surfaces 14 and 64 is not critical but preferably comprises a cylindrical surface having a radius of between two and ten inches. Excellent results have been obtained using a curved surface having a four inch radius. A flat surface would not be suitable since the area of engagement of the opposed hooked surfaces would be too large, requiring excessive effort to provide relative movement of the surfaces. Although shown as having a constant radius, the curved surfaces 14 and 64 may be surfaces characterized by a varying radius.

As illustrated in FIGS. 1, 5 and 6, the leading edge of the hooked fastener material is normally raised above the surface to be cleaned while the trailing edge and the adjacent region is enmeshed with the debris laden surface. The curvature of the body member surface permits this raised attitude of the leading edge, preventing the leading edge from abruptly biting into and arresting the progress of the cleaning stroke. As a result, as shown in FIG. 5, there is a gradual intermeshing of the hooks 20 of the cleaning device with the hooks 50 of the material to be cleaned to avoid any abrupt resistance to relative movement of the opposed hooked materials.

It is important in order to maximize the pick up of loosened debris by the sticky surface, that the sticky surface be located as closely as possible to the trailing edge of the hooked material. As shown in the enlarged view of FIG. 4, the body member 12 is relieved to accommodate the curvature of the roll 32 so that the sticky surface 30 may be disposed closely adjacent the trailing edge 28.

The roll 32 should fit the mandrel 34 relatively closely and preferably with a sufficient degree of friction to prevent the free spinning of the roll upon completion of each cleaning stroke since such spinning might tend to release collected materials from the roll as the roll is lifted from and applied to the springy hooks. The use of waxed cardboard for the roll tube 42 should provide sufficient friction to prevent undesirable spinning of the roll.

The resilient layer 44 of the roll and the strip 74 of resilient material are preferably formed of a synthetic foam such as a closed cell vinyl foam material. A foam having a thickness of approximately one sixteenth of an inch has proved satisfactory. A film of pressure sensitive adhesive such as an acrylic adhesive film applied to the foam provides an effective sticky surface for collection of the debris. In the embodiment of FIGS. 6 and 7, such a pressure sensitive adhesive can be applied to both sides of the resilient strip 74 to permit ready replacement of the strip.

Manifestly, changes in details of construction can be effected by those skilled in the art without departing from the invention.

I claim:

1. A device for cleaning the hooked portion of hook and loop fasteners comprising a body member, means on said body member defining a convexly curved surface, an array of hooked fastener elements secured to said curved surface, and means providing a sticky, debris attracting surface closely adjacent one edge of said array of hook fastener elements on said curved surface in substantially tangential alignment therewith, the relative movement of said device across a debris laden hooked fastener material engaging the array of hooked fastener elements with the debris to lift the debris therefrom for collection on said sticky surface.

2. The invention as claimed in claim 1, wherein said sticky debris attracting surface comprises a resilient surface.

3. The invention as claimed in claim 2, wherein said sticky, debris attracting resilient surface is a rotatable cylindrical surface.

4. The invention as claimed in claim 3, wherein said sticky, debris attracting resilient cylindrical surface is mounted on a demountable roll, and means on said body member for rotatably supporting said roll.

5. The invention as claimed in claim 4, wherein said means for supporting said roll comprises a split mandrel extending from said body member.

6. The invention as claimed in claim 1, including gripping means for manually grasping said body member to manually draw said array of hooked fastener elements over material to be cleaned.

7. The invention as claimed in claim 6, wherein said gripping means comprises a handle extending from the opposite end of said body member from the sticky debris attracting surface.

8. A device for cleaning the hooked portion of hook and loop fasteners comprising a body member, means on said body member defining a convexly curved surface, a strip of hooked fastener material secured to said curved surface, said strip of hooked fastener material having a leading edge and a trailing edge substantially parallel to the axis of curvature of said curved surface, a cylindrical roll having a sticky, debris attracting outer surface adjacent said trailing hooked material edge, and means for rotatably supporting said roll with the sticky surface thereof in substantially tangential alignment with the curved hooked fastener covered surface, the relative movement of said device across a debris laden hooked fastener material engaging the hooked fastener material of the device with the debris to lift the debris therefrom for collection on the sticky surface of said roll.

9. The invention as claimed in claim 8, wherein said sticky debris attracting surface comprises a resilient surface.

10. The invention as claimed in claim 9, wherein said sticky debris attracting resilient surface comprises a foam layer having a pressure sensitive adhesive film as the outer surface thereof.

11. The invention as claimed in claim 8, wherein said means for supporting said roll comprises a split mandrel extending from said body member.

12. The invention as claimed in claim 8, including gripping means for manually grasping said body member to manually draw said device over material to be cleaned.

13. The invention as claimed in claim 12, wherein said gripping means comprises a handle extending from the opposite end of said body member from said roll.

14. A device for cleaning the hooked portion of hook and loop fasteners comprising a body member, means on said body member defining a convexly curved surface, a strip of hooked fastener material secured to said surface, said hook material having a leading edge and a trailing edge each parallel to the radius of curvature of said curved surface, and a substantially planar surface extending substantially tangentially from said curved surface adjacent the trailing edge of said hooked material, and means providing a sticky, debris attracting surface on said planar surface with one edge of sticky surface being parallel to and closely adjacent said hooked material trailing edge, the relative movement of said device across a debris laden hooked fastener material engaging the hooked fastener material of the device with the debris to lift the debris therefrom for collection on said sticky surface.

15. The invention as claimed in claim 14, wherein said sticky surface comprises a resilient surface.

16. The invention as claimed in claim 15, wherein said sticky resilient surface comprises a layer of resilient foam material having a pressure sensitive adhesive film on the outer surface thereof.

17. The invention as claimed in claim 16, wherein said resilient foam layer comprises a pressure sensitive adhesive film on both sides thereof.

* * * * *